United States Patent [19]

Jones et al.

[11] Patent Number: 4,704,504

[45] Date of Patent: Nov. 3, 1987

[54] PINCHING DEACTIVATOR FOR AUTOMOBILE ELECTRIC SWITCHES

[76] Inventors: Samuel V. Jones, 12360 J Spanish Trace Dr., Maryland Heights, Mo. 63043; Kenneth Jones, 1704 J.M. Davis, Claremore, Okla. 74017

[21] Appl. No.: 887,197

[22] Filed: Jul. 21, 1986

[51] Int. Cl.[4] ..... H01H 27/00; H01H 3/20

[52] U.S. Cl. ..... 200/43.18; 200/61.79; 200/328

[58] Field of Search ..... 200/43.18, 43.08, 43.16, 200/43.19, 43.01, 43.04, 43.05, 43.06, 43.07, 318, 328, 61.79, 61.82, 61.76; 29/246; 128/354

[56] References Cited

U.S. PATENT DOCUMENTS

| | | | |
|---|---|---|---|
| 1,715,019 | 5/1929 | Von Grimmenstein | 29/246 |
| 1,879,099 | 9/1932 | Coffey | 29/246 |
| 2,656,427 | 10/1953 | Fiorucci | 200/61.82 |
| 2,786,911 | 3/1957 | Morgan | 200/61.79 |
| 2,787,680 | 4/1957 | Anderson | 200/61.79 |
| 2,810,061 | 10/1957 | Serrone | 200/61.79 |
| 2,818,480 | 12/1957 | Barker | 200/153 T |
| 2,856,477 | 10/1958 | Schultz | 200/61.79 |
| 2,873,333 | 2/1959 | Jacaman | 200/296 |
| 2,875,290 | 2/1959 | Shattow | 200/61.79 |
| 3,158,726 | 11/1964 | Morgan | 200/43.18 |
| 3,186,981 | 6/1965 | De Ronde | 200/318 |
| 3,629,529 | 12/1971 | Dietz | 200/43.19 |
| 3,678,236 | 7/1972 | Hughes | 200/43.18 |
| 3,821,504 | 6/1974 | Schomaker et al. | 200/52 R |
| 3,825,705 | 7/1974 | Bourton | 200/61.79 |

FOREIGN PATENT DOCUMENTS

| | | | |
|---|---|---|---|
| 60241 | 3/1891 | Fed. Rep. of Germany | 200/331 |
| 2409656 | 9/1974 | Fed. Rep. of Germany | 200/328 |

*Primary Examiner*—Henry J. Recla
*Assistant Examiner*—Ernest G. Cusick
*Attorney, Agent, or Firm*—William S. Dorman

[57] ABSTRACT

A deactivator for an automobile electric switch having a depressable, spring button projecting from a sleeve which extends through an opening provided in an automobile door frame and a nut mounted on the sleeve. The deactivator includes a pair of resilient pincer arms, each arm having a first end and a second end opposite from the first end whereby the first ends are spaced from each other and the second ends extend convergingly. Teeth are provided on the pincer arms near the second ends. A cross bar connects the first ends of the pincer arms. A pair of handles substantially parallel to the pincer arms are connected to the pincer arms near the second ends. A thumbscrew is threadably received in a circular opening provided in the cross bar. The deactivator is attached to the electric switch by squeezing the handles together to spread apart the lower ends of the pincer arms, placing the pincer arms around the nut, releasing the handles to allow the teeth on the pincer arms to grip the nut, and turning the thumbscrew in order to depress the button.

3 Claims, 6 Drawing Figures

PINCHING DEACTIVATOR FOR AUTOMOBILE ELECTRIC SWITCHES

BACKGROUND OF THE INVENTION

1. Field of the Invention

The present invention relates to an automobile electric switch deactivator for a switch having a depressable, spring button projecting from a sleeve which extends through an opening provided in the automobile frame and a nut mounted on the sleeve.

2. Background of the Invention

The typical automobile electrical system includes an interior light or lights and a warning buzzer to alert the driver that the key is in the ignition.

When a front door of the automobile is opened, the interior light goes on and, if the key is in the ignition, the warning buzzer sounds. The light and buzzer are activated by a switch on the front door post of the automobile. The switch usually consists of a spring projected button which is in the depressed position when the front door is closed. When the front door is opened, the button is released.

Deactivating the switch is desirable for several reasons, including making repairs and providing ventilation when the automobile is parked. The present invention would keep the warning buzzer and light off even though the front door is open which reduces drain on the battery and eliminates an annoying sound.

Therefore, it is a principal object and purpose of the present invention to provide an improved automobile electric switch deactivator that is of simple construction and that may be easily attached without the use of fasteners.

A patentability search was conducted on the present invention and the following U.S. patents were uncovered in the search:

| Patentee | U.S. Pat. No. | Issue Date |
|---|---|---|
| Von Grimmenstein | 1,715,019 | May 28, 1929 |
| Coffey | 1,879,099 | Sept. 27, 1932 |
| Morgan | 2,786,911 | March 26, 1957 |
| Anderson | 2,787,680 | April 2, 1957 |
| Serrone | 2,810,061 | Oct. 15, 1957 |
| Barker | 2,818,480 | Dec. 31, 1957 |
| Schultz | 2,856,477 | Oct. 14. 1958 |
| Jacaman | 2,873,333 | Feb. 10, 1959 |
| Shattow | 2,875,290 | Feb. 24, 1959 |
| Morgan | 3,158,726 | Nov. 24, 1964 |
| De Ronde | 3,186,981 | June 1, 1965 |
| Hughes | 3,678,236 | July 18, 1972 |
| Schomaker et al. | 3,821,504 | June 28, 1974 |
| Bourton | 3,825,705 | July 23, 1974 |

As can be seen, deactivating devices for spring button electric switches are known in the art. The present invention, however, provides a simple deactivator that may be easily attached and removed without the use of permanent fasteners such as screws. Additionally, the present invention is superior to the known art, being adaptable to electric switches of varying dimensions.

SUMMARY OF THE INVENTION

The present invention provides an automobile electric switch deactivator for an electric switch having a sleeve which extends through an opening provided on the front door post of an automobile. A spring button projects from and through the sleeve and is held in place by a nut. The deactivator has pincer arms having upper ends connected by a cross bar and lower ends that extend convergingly downward. Teeth are provided on the inside lower ends of the arms to grip the nut. A handle is hingedly connected to each pincer arm parallel to and in communication with the pincer arm. When the handles are squeezed together, the lower ends of the arms are spread apart, allowing the teeth to be placed around the nut. A circular opening in the cross bar threadably receives a thumbscrew which may be turned to depress the button, thereby interrupting the electric circuit.

DETAILED DESCRIPTION OF THE PREFERRED EMBODIMENTS

Figure 4:
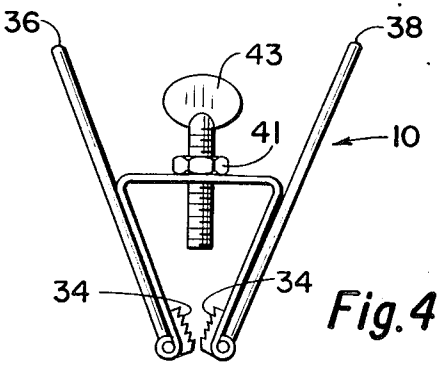
FIG. 4 is a front view of the present invention as shown in FIG. 1 detached from the automobile electric switch.

Referring to the drawings in detail, FIGS. 1 through 4 show an automobile electric switch deactivator 10 constructed in accordance with one embodiment of the present invention.

In the typical automobile (not shown), an electric switch 12 includes a sleeve 14 which extends through an opening provided on the front door post (not shown) of the automobile. A spring button 16 projects from and through the sleeve. The button 16 and sleeve 14 are held in place by a nut 18 which is threadably secured to the outside of the sleeve. The sleeve, button and nut will be of varying dimensions depending on the automobile model.

When the front door is open, the button is released, the circuit is completed, the interior lights will go on and, if the key is in the ignition, the warning buzzer will sound. When the front door is closed, the button is in the depressed position and the electrical circuit is interrupted.

Figure 3:
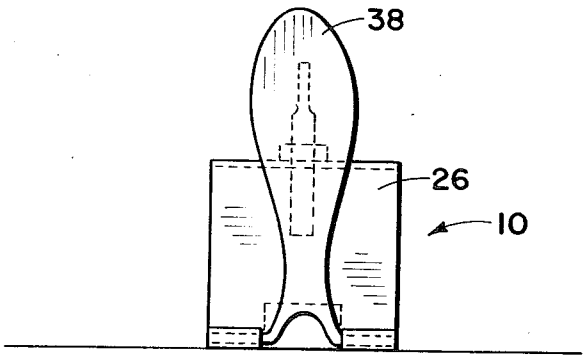
FIG. 3 is a sectional view of the present invention as shown in FIG. 1 taken along section line 3—3 of FIG. 1.
Figure 2:
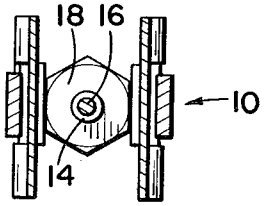
FIG. 2 is a sectional view of the present invention as shown in FIG. 1 taken along section line 2—2 of FIG. 1.
Figure 1:
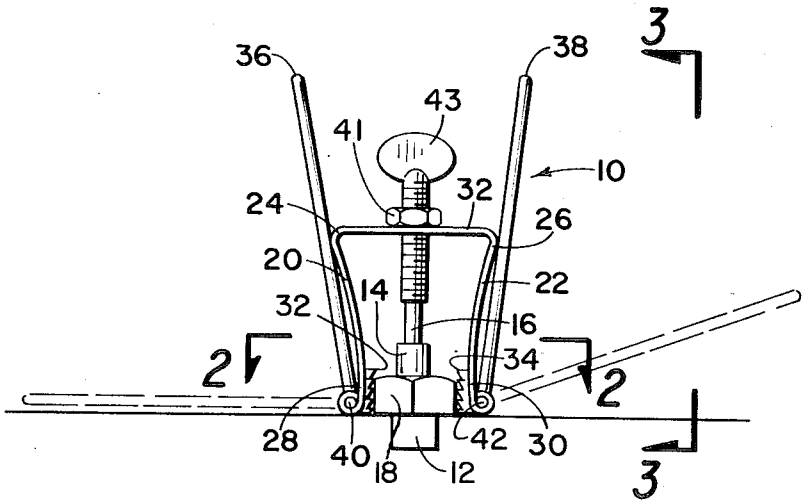
FIG. 1 is a front view of an automobile electric switch deactivator constructed in accordance with one embodiment of the present invention and shown attached to an automobile electric switch.

FIGS. 1, 2 and 3 show the deactivator 10 in place over the electric switch 12 in order to interrupt the electrical circuit while FIG. 4 shows the deactivator deattached from the electric switch. Pincer arms 20 and 22 each have upper ends 24 and 26 and lower ends 28 and 30, respectively. The upper ends 24 and 26 are spaced from each other and are connected by cross bar 32.

When the deactivator 10 is unattached, as best seen in FIG. 4, the arms 20 and 22 extend convergingly downward toward lower ends 28 and 30. The pincer arms and the cross bar are constructed of a resilient material, such as thin sheet metal.

Teeth 34 are provided on the inside of the lower ends 28 and 30 of the arms and are adapted, as will be seen, to grip the nut 18.

A pair of handles 36 and 38 are connected to pincer arms 20 and 22 at hinges 40 and 42, respectively. The handles 36 and 38 are positioned parallel to and in communication with pincer arms 20 and 22, respectively. Each handle acts as a lever to move its respective pincer arm. Although the handles are connected at the lower ends of the pincer arms, it should be understood that in the present embodiment, the hinges may be located elsewhere on the pincer arms.

An optional nut 41 is positioned above a circular opening (not shown) in the cross bar 32 to stabilize and threadably receive a thumbscrew 43.

The deactivator is attached to the electric switch 12 in accordance with the following procedure. Squeezing the upper ends of the handles 36 and 38 together will spread the lower ends 28 and 30 of the pincer arms. The teeth on the lower ends 28 and 30 are then placed around the nut and the handles are released. When the handles are released, the lower ends of the pincer arms will move together and the teeth will communicate with the nut 18. After the pincer arms 20 and 22 are in place gripping the nut 18, the upper ends of the handles 36 and 38 may be spread apart to provide greater access to the thumbscrew 42. The thumbscrew 42 is turned in order to depress the button 16, thereby interrupting the electric circuit. The interior light and warning buzzer will thus be kept off even though the front door is opened.

To remove the deactivator, the reverse operation is performed.

Figure 6:
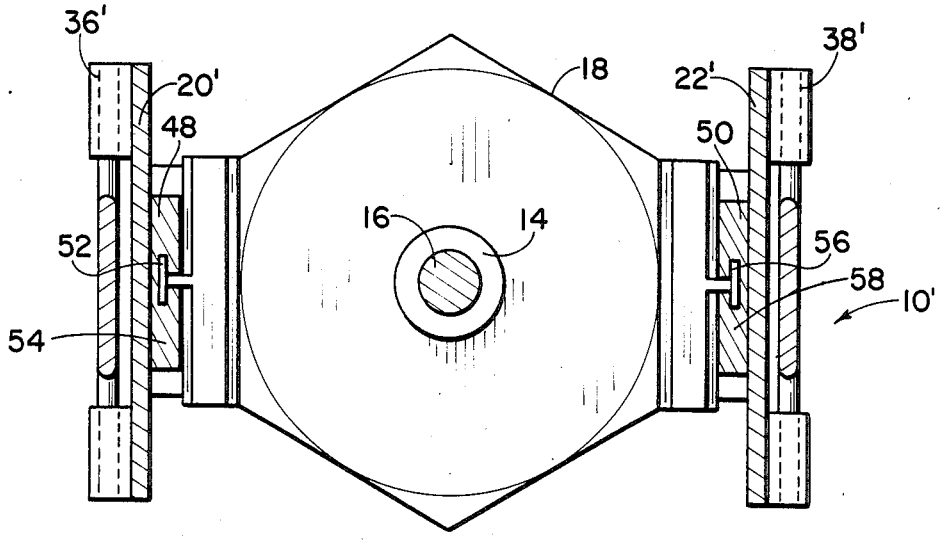
FIG. 6 is a sectional view of the present invention as shown in FIG. 5 taken along section line 5—5 of FIG. 5.
Figure 5:
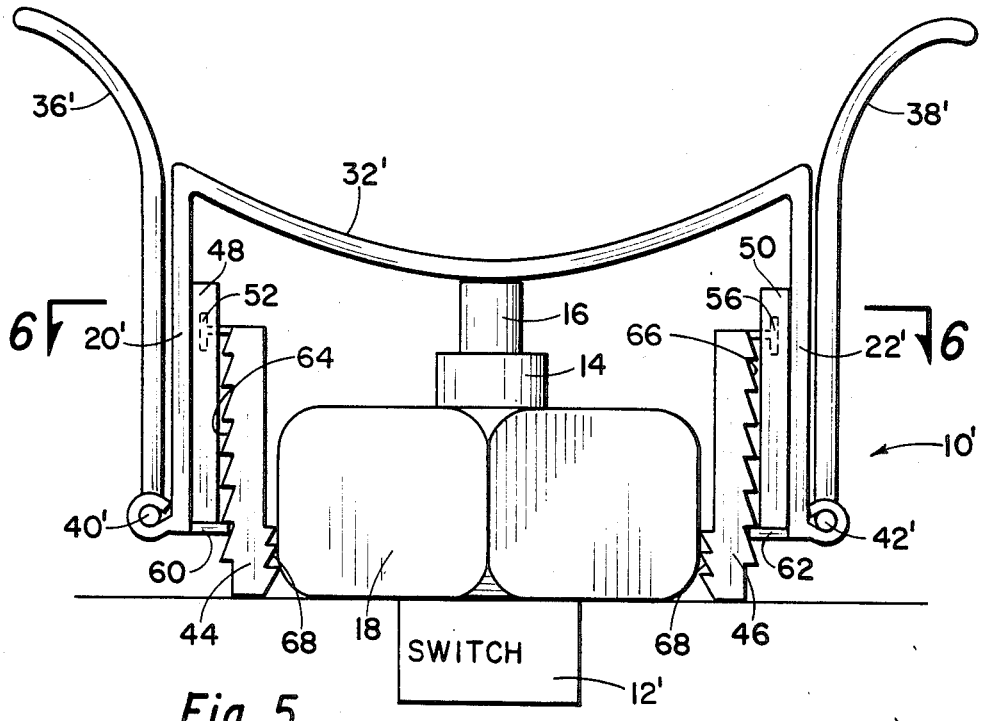
FIG. 5 is a front view of an automobile electric switch deactivator constructed in accordance with an alternate embodiment of the present invention and shown attached to an automobile electric switch.

An alternate embodiment of the deactivator is shown in FIGS. 5 and 6. As will be seen, the alternate embodiment is additionally advantageous since it may remain attached to the automobile even with the front door closed. The pincer arms 20' and 22' converge and are separated upon attachment of the deactivator to the switch 12. Squeezing the upper ends of the handles 36' and 38' will spread the pincer arms 20' and 22'. Pincer arms 20' and 22' are connected to retractable members 44 and 46, respectively, through tracks 48 and 50, respectively. Retractable member 44 has a tongue 52 which is slidably received in a slot 54 provided on track 48. Retractable member 46 has a tongue 56 which slidably received in a slot 58. Ratchet mechanisms consisting of pawls 60 and 62 and inclined teeth 64 and 66 allow movement of the pincer arms in one direction only. Teeth 68 are provided on retractable members 44 and 46 in order to grip the nut 18.

It can be appreciated that the position of the cross bar 32' would vary depending on the extension of the retractable members 44 and 46. The cross bar 32' would thus be lowered to depress the button 16. The handles 36' and 38' are connected to the pincer arms 20' and 22' by the hinges 40' and 42'. Once the deactivator is in place, the handles may be spread apart and folded down. With the handles folded down, the door of the automobile could be closed while the invention is in place.

Whereas, the present invention has been described in particular relation to the drawings attached hereto, it should be understood that other and further modifications, apart from those shown or suggested herein, may be made within the spirit and scope of this invention.

What is claimed is:

1. A deactivator for an automobile electric switch having a depressable, spring button projecting from a sleeve which extends through an opening provided in an automobile door frame and a nut threadably securing said sleeve to said frame, wherein said deactivator comprises: a pair of resilient pincer arms, each arm having a first end and a second end opposite from said first end whereby said first ends are spaced from each other and said second ends extend convergingly; teeth provided on said pincer arms near said second ends and facing each other; a cross bar connecting said first ends of said pincer arms and having a central opening therethrough extending in the direction of said arms; a pair of handles substantially parallel to said pincer arms and connected to said pincer arms near said second ends and extending beyond such first ends; and a thumbscrew threadably received in said opening provided in said cross bar, whereby said deactivator may be attached to said electric switch by squeezing said handles together to spread apart said lower ends of said pincer arms, placing said teeth on said lower ends around said nut, releasing said handles to allow said teeth to grip said nut, and turning said thumbscrew in order to depress said button.

2. An automobile electric switch deactivator as set forth in claim 1 wherein said handles are hingedly connected to said arms so that said handles may be spread apart to provide greater access to said thumbscrew.

3. A deactivator for an automobile electric switch having a depressable, spring button projecting from a sleeve which extends through an opening provided in an automobile door frame and a nut threadably securing said sleeve to said frame, wherein said deactivator comprises: a pair of resilient pincer arms, each arm having a first end and a second end opposite from said first end whereby said first ends are spaced from each other and said second ends converge and are separated upon attachment to said switch; a cross bar connecting said first ends of said pincer arms; a pair of handles substantially parallel to said pincer arms and extending beyond said first ends, each handle connected to a pincer arm near said second end; means to hingedly connect said handles to said arms; a pair of retractable members substantially parallel to said pincer arms and adjacent thereto; means to slidably connect said retractable members to said pincer arms; ratchet means to allow movement of said retractable members in one direction only; and gripper teeth provided on said retractable members and facing each other, whereby said deactivator may be attached to said electric switch by squeezing said handles together to spread apart said retractable members, placing said gripper teeth on said retractable members around said nut, releasing said handles to allow said teeth to grip said nut, and lowering said cross bar in order to depress said button.

* * * * *